US010043630B2

(12) United States Patent
Siebens et al.

(10) Patent No.: US 10,043,630 B2
(45) Date of Patent: Aug. 7, 2018

(54) FUSE INSULATING SUPPORT BRACKET WITH PRE-MOLDED SHED

(71) Applicant: Thomas & Betts International, LLC, Wilmington, DE (US)

(72) Inventors: Larry N. Siebens, Asbury, NJ (US); Daniel L. Gardner, Stewartsville, NJ (US); Gary Haynes, Sorrento, FL (US)

(73) Assignee: Thomas & Betts International LLC, Wilmington, DE (US)

( * ) Notice: Subject to any disclaimer, the term of this patent is extended or adjusted under 35 U.S.C. 154(b) by 240 days.

(21) Appl. No.: 14/600,494

(22) Filed: Jan. 20, 2015

(65) Prior Publication Data

US 2015/0270087 A1 Sep. 24, 2015

Related U.S. Application Data

(60) Provisional application No. 61/968,020, filed on Mar. 20, 2014.

(51) Int. Cl.
*H01H 85/22* (2006.01)
*H01H 31/12* (2006.01)
(Continued)

(52) U.S. Cl.
CPC ..... *H01H 85/22* (2013.01); *H01H 31/127* (2013.01); *H01H 69/02* (2013.01); *H01H 85/042* (2013.01); *H01H 2239/044* (2013.01)

(58) Field of Classification Search
CPC ..... H01H 85/22; H01H 85/042; H01H 69/02; H01H 31/127; H01H 2239/044; H01H 31/122; H01H 2085/0034
(Continued)

(56) References Cited

U.S. PATENT DOCUMENTS 3,868,615 A 2/1975 Haubein et al.
3,898,372 A 8/1975 Kalb
(Continued)

FOREIGN PATENT DOCUMENTS

CN 201845734 U 5/2011
CN 202013858 U 10/2011
(Continued)

OTHER PUBLICATIONS

Doug Lescarbeau and Rob Dunkel, "Increasing Strength and Reliability of Interference Fits", Oct. 1, 2013, Assembly Magazine, Entire Document.*

(Continued)

*Primary Examiner* — Anatoly Vortman
*Assistant Examiner* — Stephen Sul
(74) *Attorney, Agent, or Firm* — Taft Stettinius & Hollister LLP

(57) ABSTRACT

A support bracket for a fuse cutout may include an insulating rod with a first threaded standoff at a top end of the insulating rod and a second threaded standoff at a bottom end of the insulating rod. One or more shed sleeves may be secured over an outside surface of the insulating rod between the first threaded standoff and the second threaded standoff. The interior surface of the one or more shed sleeves forms a dielectric interface between the outside surface of the insulating rod and the interior surface of the shed sleeve. A mounting bracket may be secured to a portion of the support bracket between the first threaded standoff and the second threaded standoff. The one or more shed sleeves may be pre-molded prior to installation over the insulating rod.

13 Claims, 8 Drawing Sheets

(51) Int. Cl.
*H01H 69/02* (2006.01)
*H01H 85/042* (2006.01)

(58) Field of Classification Search
USPC ..... 337/171, 6, 5, 411, 205, 222, 227, 31, 337/168
See application file for complete search history.

(56) References Cited

U.S. PATENT DOCUMENTS

| | | | | |
|---|---|---|---|---|
| 3,962,667 | A * | 6/1976 | Link | H01B 17/28 174/142 |
| 4,527,028 | A | 7/1985 | Luehring | |
| 4,714,438 | A | 12/1987 | Williams | |
| 4,724,284 | A | 2/1988 | Wheeler | |
| 4,744,765 | A | 5/1988 | DeLeo | |
| 4,822,289 | A | 4/1989 | DeLeo | |
| 4,859,192 | A | 8/1989 | DeLeo | |
| 4,896,008 | A | 1/1990 | Aoki et al. | |
| 4,941,834 | A | 7/1990 | DeLeo | |
| 5,131,855 | A | 7/1992 | Pickering | |
| 5,214,249 | A * | 5/1993 | Goch | H01B 17/06 174/141 R |
| 5,563,379 | A | 10/1996 | Kunieda et al. | |
| 5,667,060 | A | 9/1997 | Luzzi | |
| 6,075,209 | A | 6/2000 | Luzzi | |
| 6,172,317 | B1 | 1/2001 | Wristen | |
| 6,225,567 | B1 * | 5/2001 | Kester | H01T 4/04 174/178 |
| 6,310,310 | B1 | 10/2001 | Wristen | |
| 6,462,639 | B1 | 10/2002 | Farag et al. | |
| 6,485,326 | B1 | 11/2002 | Trainor et al. | |
| 6,593,842 | B2 | 7/2003 | Haynam et al. | |
| 6,952,154 | B2 | 10/2005 | Almgren et al. | |
| 7,094,974 | B2 | 8/2006 | Ohkawa et al. | |
| 7,180,003 | B2 | 2/2007 | Almgren et al. | |
| 7,435,120 | B2 | 10/2008 | Janicke et al. | |
| 7,532,103 | B2 | 5/2009 | Almgren et al. | |
| 7,661,979 | B2 | 2/2010 | Hughes et al. | |
| 7,717,736 | B2 | 5/2010 | Chua et al. | |
| 7,772,515 | B2 | 8/2010 | Skiving et al. | |
| 7,883,356 | B2 | 2/2011 | Hughes et al. | |
| 7,909,635 | B2 | 3/2011 | Hughes et al. | |
| 8,038,457 | B2 | 10/2011 | Hughes et al. | |
| 8,049,129 | B2 | 11/2011 | Wristen et al. | |
| 2002/0135452 | A1 * | 9/2002 | White | H02K 11/25 337/104 |
| 2002/0158745 | A1 | 10/2002 | Haynam et al. | |
| 2004/0155014 | A1 | 8/2004 | Schreiber et al. | |
| 2008/0174399 | A1 * | 7/2008 | Benke | H01H 31/127 337/168 |
| 2009/0160598 | A1 | 6/2009 | Benke et al. | |

FOREIGN PATENT DOCUMENTS

| | | | |
|---|---|---|---|
| CN | 202042292 | U | 11/2011 |
| CN | 202423198 | U | 9/2012 |
| CN | 202549769 | U | 11/2012 |
| DE | 19921477 | A1 | 11/2000 |
| EP | 2634786 | A1 | 9/2013 |
| FR | 2868875 | A1 | 10/2005 |
| JP | 2001084854 | A | 3/2001 |
| JP | 4400955 | B2 | 1/2010 |
| WO | 0041199 | A1 | 7/2000 |
| ZA | 20006273 | A | 5/2001 |

OTHER PUBLICATIONS

"BOSS 9609 Press Fit Retaining Compound", BOSS Products, Aug. 26, 2016, Entire Document.*

Canadian Intellectual Property Office; Office Action issued in corresponding Canadian Patent Application No. 2,881,884; dated Feb. 15, 2016; 4 pages.

European Patent Office; European Search Report issued in corresponding Application No. 15157310.2; dated Mar. 8, 2015; 10 pages.

The State Intellectual Property Office of the People's Republic of China; Search Report issued in corresponding Chines Patent Application No. 201510112005.8; dated Mar. 13, 2015; 2 pages.

* cited by examiner

FUSE INSULATING SUPPORT BRACKET WITH PRE-MOLDED SHED

CROSS-REFERENCE TO RELATED APPLICATION

This application claims priority under 35 U.S.C. § 119, based on U.S. Provisional Patent Application No. 61/968,020 filed Mar. 20, 2014, the disclosure of which is hereby incorporated by reference herein.

BACKGROUND OF THE INVENTION

The present invention relates to a fuse cutout that can be used with power distribution systems to protect against electrical overload. Outdoor cutouts, such as a high voltage dropout fuse, may provide overcurrent protection for equipment that can be damaged by system overload or fault conditions. Such outdoor cutouts may be used to clear fault or overload currents on a section of an overhead distribution line or a damaged piece of equipment.

An outdoor cutout may include a fuse tube (including a fuse element) and a mounting insulator that electrically isolates the conductive portions of the cutout from the support to which the cutout is fastened. The mounting insulator typically includes an outer shield. The outer shield generally includes a number of radially extending fins for increasing creep and flashover distance on the exterior of the insulator. In conventional systems, the outer shield is formed by over-molding the insulator as a single piece.

DETAILED DESCRIPTION OF THE PREFERRED EMBODIMENTS

The following detailed description refers to the accompanying drawings. The same reference numbers in different drawings may identify the same or similar elements.

Systems and/or methods described herein relate to a support bracket for a fuse cutout. In one implementation, the support bracket may include an insulating rod with a first threaded standoff at a top end of the insulating rod and a second threaded standoff at a bottom end of the insulating rod. One or more shed sleeves may be secured, via an interference fit, over an outside surface of the insulating rod between the first threaded standoff and the second threaded standoff. The interior surfaces of the one or more shed sleeves form a dielectric interface between the outside surface of the insulating rod and the interior surface of the shed sleeve. A mounting bracket may be secured to a portion of the support bracket between the first threaded standoff and the second threaded standoff. The one or more shed sleeves may be pre-molded prior to installation over the insulating rod.

In another implementation, a support bracket for a fuse cutout may include an insulating rod having a top portion, a bottom portion opposite the top portion, and a middle portion between the top portion and the bottom portion. A first shed sleeve may be secured, via an interference fit, over an outside surface of the top portion, such that an interior surface of the first shed sleeve forms a dielectric interface between the outside surface of the top portion and the interior surface of the first shed sleeve. Similarly, a second shed sleeve may be secured, via another interference fit, over an outside surface of the bottom portion, such that an interior surface of the second shed sleeve forms a dielectric interface between the outside surface of the bottom portion and the interior surface of the second shed sleeve. A mounting bracket may be secured to the middle portion of the insulating rod between the first shed sleeve and the second shed sleeve.

Figure 1:
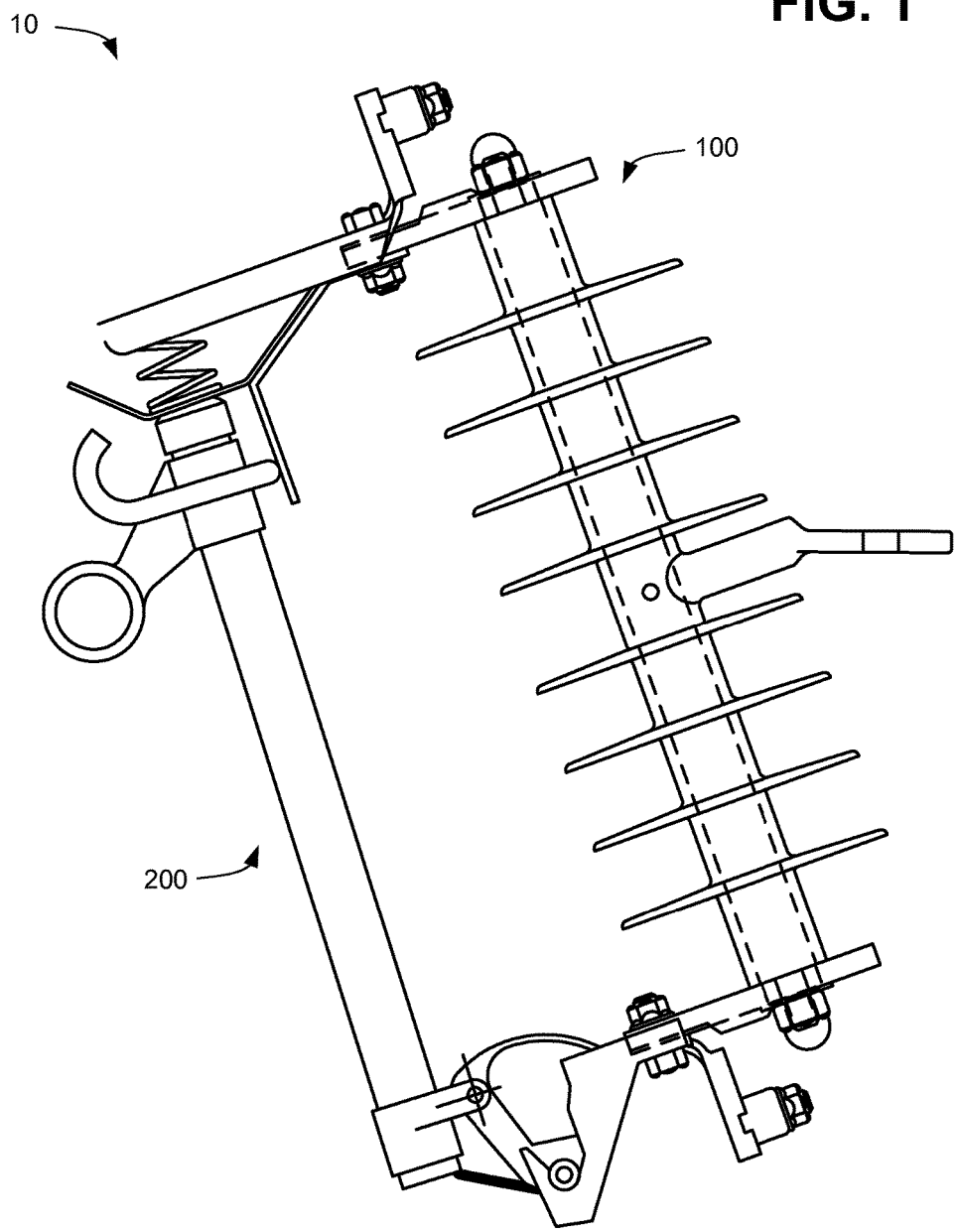
FIG. 1 is a side view illustrating a fuse cutout assembly according to an implementation described herein.

FIG. 1 provides a diagram of an exemplary device 10 in which systems and/or methods described herein may be implemented. In one implementation, device 10 may include a fuse cutout assembly. Device 10 may be used, for example, on overhead power distribution systems.

As used in this disclosure with reference to the apparatus (e.g., device 10), the term "high voltage" refers to equipment configured to operate at a nominal system voltage above 3 kilovolts (kV). Thus, the term "high voltage" refers to equipment suitable for use in electric utility service, such as in systems operating at nominal voltages of about 3 kV to about 38 kV, commonly referred to as "distribution" systems, as well as equipment for use in "transmission" systems, operating at nominal voltages above about 38 kV.

Device 10 may generally include a support bracket 100 that supports a fuse assembly 200. Device 10 may provide overcurrent protection for equipment that can be damaged by system overload or fault conditions. As shown in FIG. 1, device 10 is typically mounted with fuse assembly 200 at an angle to allow a portion of fuse assembly 200 to rotate and fall open under its own weight when a fuse blows. More particularly, when an overload condition occurs, a fuse link in fuse assembly 200 will melt causing fuse assembly 200 to drop and interrupt current through device 10.

Figure 2:
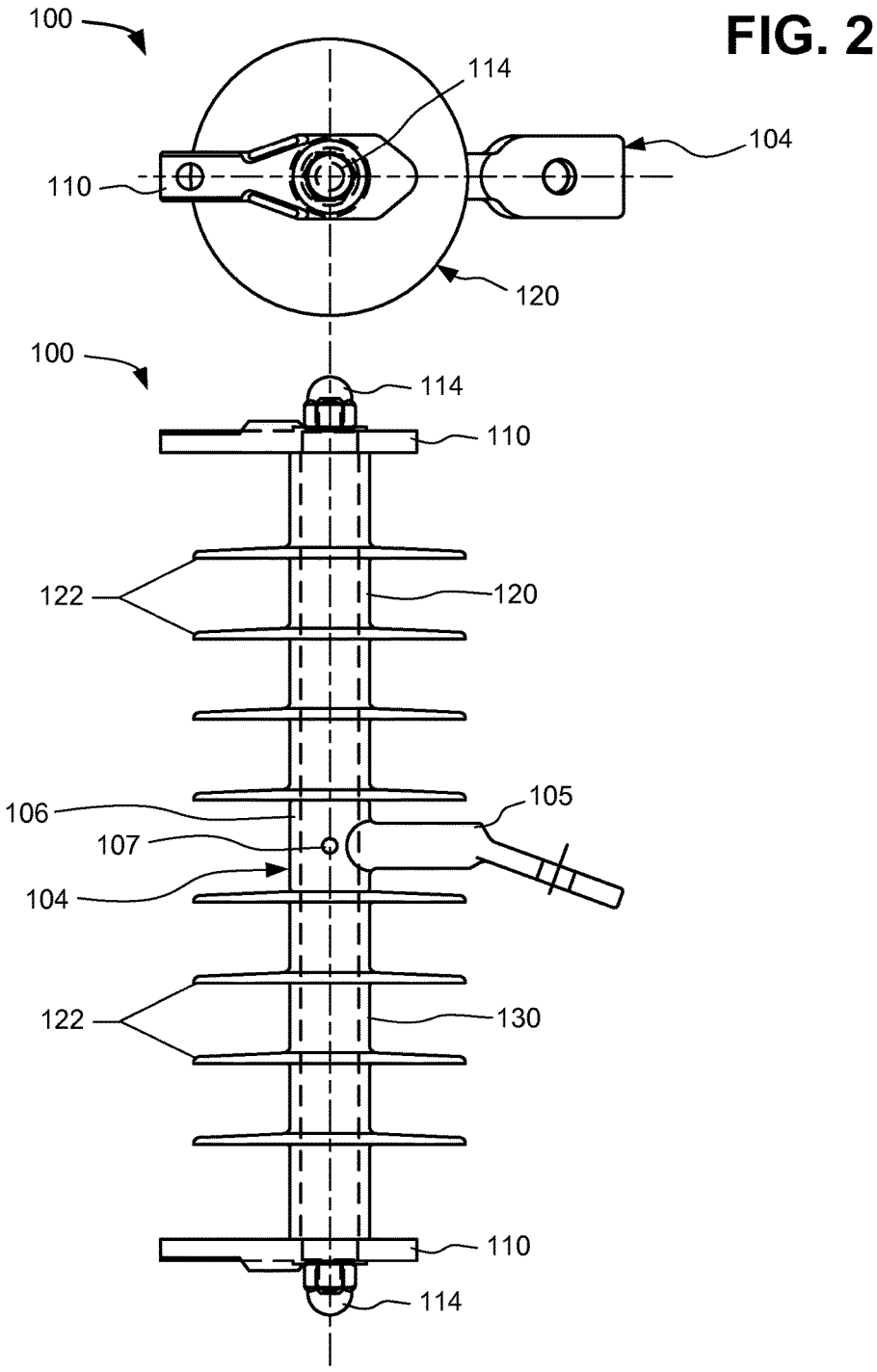
FIG. 2 is a side view and a top view of the support bracket of the fuse cutout assembly of FIG. 1.
Figure 3:
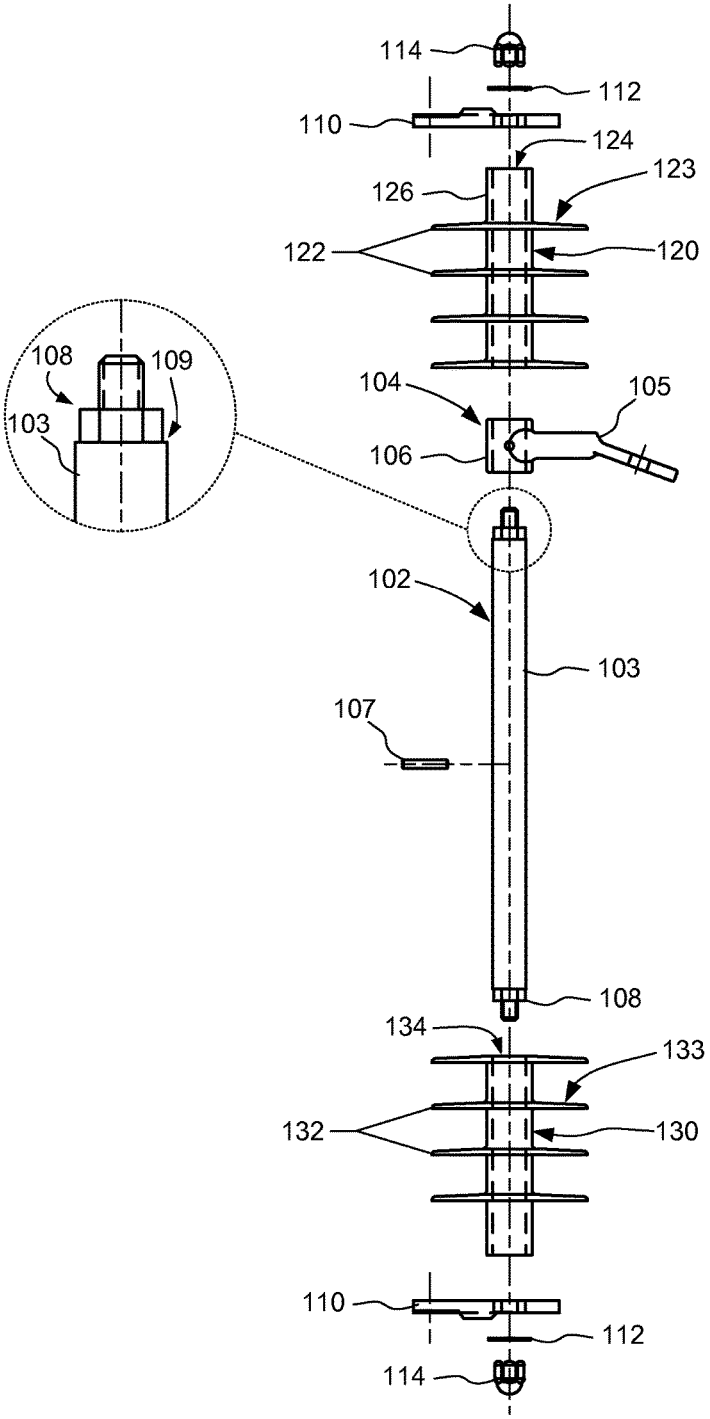
FIG. 3 is an exploded side assembly view of the support bracket of FIG. 2.

FIG. 2 includes a side and top views of support bracket 100, and FIG. 3 is an assembly or exploded view of support bracket 100. Referring collectively to FIGS. 2 and 3, support bracket 100 may include an insulating rod 102 with a mounting bracket 104. Insulating rod 102 may include a solid insulating core 103 with a threaded standoff 108 at each end of insulating rod 102. Insulating core 103 may include, for example, a fiberglass material or another insulating material. For example, insulating core 103 may include a glass-reinforced epoxy laminate tube in accordance with National Electrical Manufacture Association (NEMA) designation G-10 or FR-4.

Mounting bracket 104 may include an elbow section 105 and a ring 106 formed, for example, of galvanized steel. Elbow section 105 (also referred to as a flange) may include a mounting aperture and an angled frame to allow device 10 to be mounted to a grounding element at an angle from vertical (e.g., as shown in FIG. 1). Ring 106 of mounting bracket 104 may be slid over insulating rod 102 and secured to a middle portion of insulating rod 102 using a pin 107 inserted through insulating core 103 and ring 106.

Each threaded standoff 108 may include, for example, a male or female hex connector with a stud mounted thereon. The hex connector of threaded standoff 108 may be mounted to an end of insulating core 103 so as to form a shoulder 109 at the interface of insulating core 103 and threaded standoff 108. In one implementation, threaded standoff 108 may receive an end bracket 110 (which may abut against shoulder 109), secured via a washer 112 and a nut 114 onto the stud of standoff 108. To keep end bracket 110 from rotating, a hex shaped aperture may be machined into end bracket 110 to match the hex shape portion of threaded standoff 108. When end bracket 110, washer 112, and nut 114 are secured to each threaded standoff 108 at the ends of insulating rod 102, fuse assembly 200 may be mounted to each end bracket 110.

Support bracket 100 may also include an upper insulator shed sleeve 120 and a lower insulator shed sleeve 130 (referred to herein collectively as "insulator shed sleeves 120/130" or generically as "insulator shed sleeve 120/130") to prevent voltage flashover or voltage tracking due to moisture and contamination. Insulator shed sleeves 120/130 may generally be formed from, for example, a dielectric silicone, a thermoplastic elastomer or rubber, which is vulcanized under heat and pressure, such as an ethylene-propylene-dienemonomer (EPDM) elastomer. According to implementations described herein, insulator shed sleeves 120/130 may be pre-molded components with an interior bore that is sized to be forced over the circumference of insulating rod 102 and maintain position via an interference fit with insulating core 103. In one implementation, the pre-molded shed sleeves 120/130 may be manufactured in an automated manner that removes the flash (e.g., unwanted material left by the molding process) without manual processing.

The outer surface of insulating core 103 (e.g., along the circumference of insulating rod 102) is generally smooth and cylindrical to provide clean contact with an interior surface of each insulator shed sleeve 120/130. The interference fit (also referred to as a friction fit) ensures that an interior surface of each insulator shed sleeve 120/130 forms a dielectric interface between the outside surface insulating rod 102 and insulator shed sleeve 120/130.

In some implementations, insulator shed sleeves 120/130 may each include a number of radially extending fins 122/132 for increasing a creep distance on an exterior of support bracket 100. Fins 122/132 may be desirable in above-ground or weather-exposed switch installations. Increased creep distance may be provided, for example, by changing the spacing and/or dimensions of fins 122/132 on insulator shed sleeves 120/130.

In one implementation, the configuration of upper insulator shed sleeve 120 and lower insulator shed sleeve 130 may be identical to provide interchangeable components for upper insulator shed sleeve 120 and lower insulator shed sleeve 130. In another implementation, as shown in FIGS. 1-3, upper insulator shed sleeve 120 and lower insulator shed sleeve 130 may be substantially similar, but fins 122 and fins 132 may have a slope 123/133 in opposite directions (e.g., so as to provide slopes in the same direction when upper insulator shed sleeve 120 and lower insulator shed sleeve 130 are installed on opposite ends of insulating rod 102). In still other implementations, upper insulator shed sleeve 120 and lower insulator shed sleeve 130 may have different axial lengths and/or different amounts of fins 122/132 (e.g., depending on the installed location of mounting bracket 104).

As shown in FIG. 3, upper shed sleeve 120 and lower shed sleeve 130 may slide over the top and bottom ends of insulating rod 102, respectively. In some embodiments, upper shed sleeve 120 and lower shed sleeve 130 may be held in place on insulating rod 102 via an interference fit. That is, upper shed sleeve 120 and lower shed sleeve 130 may each have a central bore (references 124 and 134, respectively) with a circumference sized such that it may be stretched over the circumference of insulating core 103. The interference fit provides a substantially void-free dielectric interface between the outside surface of insulating core 103 and the interior surfaces of insulator shed sleeves 120/130 (e.g., along central bores 124/134) without using a bonding agent. In one implementation, insulator shed sleeves 120/130 may be pushed over insulating rod 102 without any additional materials (such as sealants, lubricants, or adhesives) used at the interface between the outside surface of insulating rod 102 and the interior surfaces of insulator shed sleeves 120/130.

Figure 4:
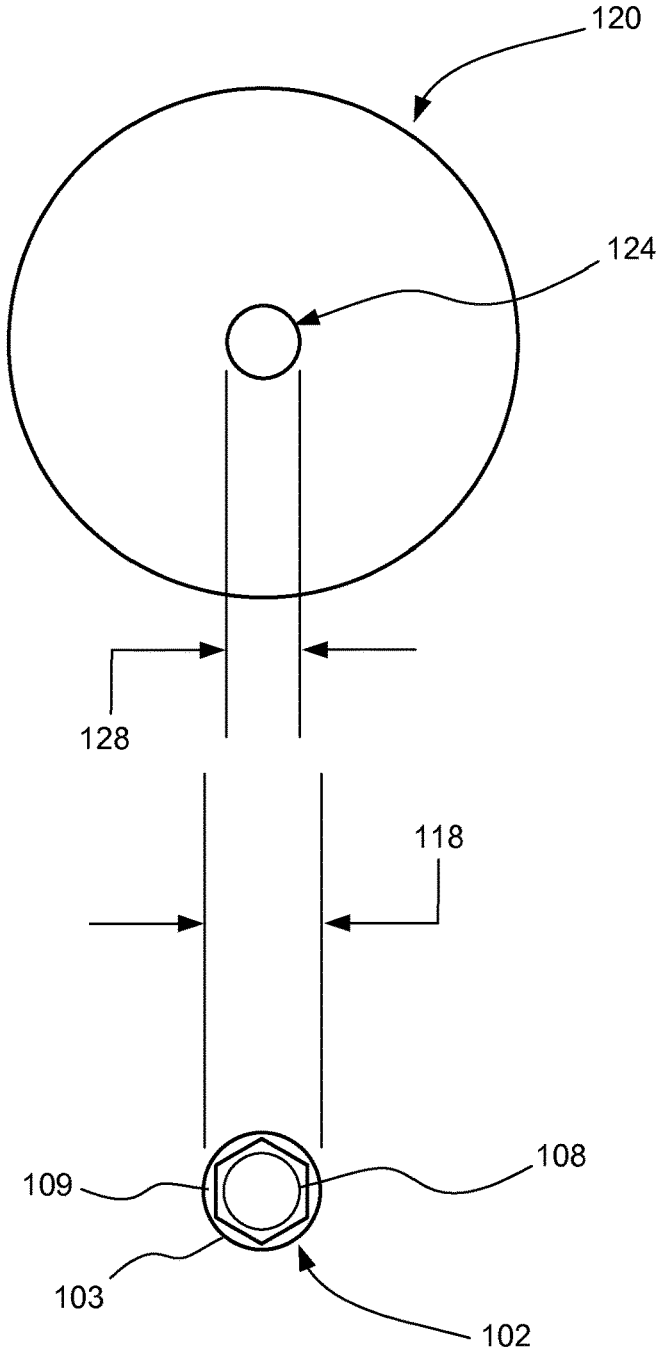
FIG. 4 provides a bottom view of an upper shed sleeve and a top view of a top portion of an insulating rod of FIG. 3.

FIG. 4 provides a simplified bottom view of upper shed sleeve 120 and a simplified top view of insulating rod 102 to illustrate the interference fit of upper shed sleeve 120 and insulating rod 102. Lower shed sleeve 130 may be configured similarly to upper shed sleeve 120 to provide a similar interference fit of lower shed sleeve 130 and insulating rod 102. As shown in FIG. 4, an outside diameter 118 of insulating rod 102 is larger than the inside diameter 128 of central bore 124 of upper shed sleeve 120. The interior surface of upper shed sleeve 120, along central bore 124, is generally smooth and cylindrical. Thus, upper shed sleeve 120 can be stretched, manipulated, pushed, and/or forced over insulating rod 102 to provide an airtight/watertight fit with a consistent hoop force being applied to insulating rod 102 upon installation. The interference fit between insulating rod 102 and upper shed sleeve 120 may provide a dielectric interface between insulating rod 102 and upper shed sleeve 120. Lower shed sleeve 130 may be applied over a different portion of insulating rod 102. For example, upper shed sleeve 120 may be configured to cover the cylindrical portion of insulating rod 102 above mounting bracket 104, and lower shed sleeve 130 may be configured to cover the cylindrical portion of insulating rod 102 below mounting bracket 104.

Figure 5A:
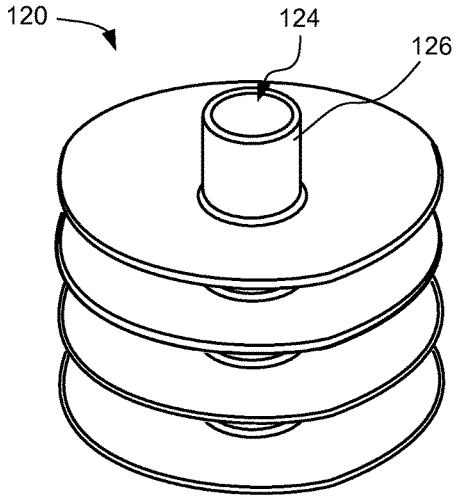
FIG. 5A is side perspective view of an upper shed sleeve of the support bracket of FIG. 2.
Figure 5B:
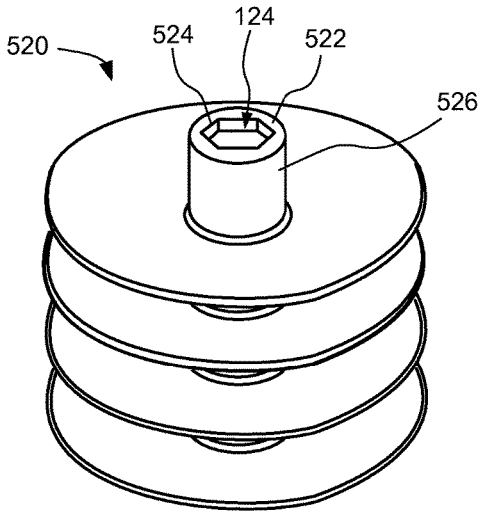
FIG. 5B is side perspective view of another upper shed sleeve according to another implementation described herein.

FIG. 5A is side perspective view of upper shed sleeve 120. FIG. 5B is a side perspective view of an upper shed sleeve 520 according to another implementation described herein. Referring collectively to FIGS. 3 and 5A, a stem section 126 of upper shed sleeve 120 may be shaped so that upper shed sleeve 120 may slide completely over the top portion of insulating rod 102 and that central bore 124 may terminate against top end bracket 110 when support bracket 100 is assembled. Lower shed sleeve 130 (not shown in FIG. 5A) may be similarly configured and assembled onto the lower portion of insulating rod 102.

In contrast, referring collectively to FIGS. 3 and 5B, upper shed sleeve 520 may include a stem section 526 that incorporates an integrated gasket 522 with a hex-shaped opening 524. Hex-shaped opening 524 may be sized to fit/stretch over the hex portion of threaded standoff 108. Gasket 522 may join to stem section 526 to partially cover central bore 124 and prevent insertion of upper shed sleeve 520 past shoulder 109 of insulating rod 102. Thus, when support bracket 100 is assembled using upper shed sleeve 520 instead of upper shed sleeve 120, top end bracket 110 may be secured over the hex portion of threaded standoff 108 and gasket 522 to form a seal between shoulder 109 of insulating rod 102 and top end bracket 110. Also, gasket 112 may seal between top end bracket 110 and nut 114 to provide a weatherproof seal around the top end of insulating core 103. A lower shed sleeve (not shown) may be configured similarly to upper shed sleeve 520 and assembled onto the lower portion of insulating rod 102.

Figure 6:
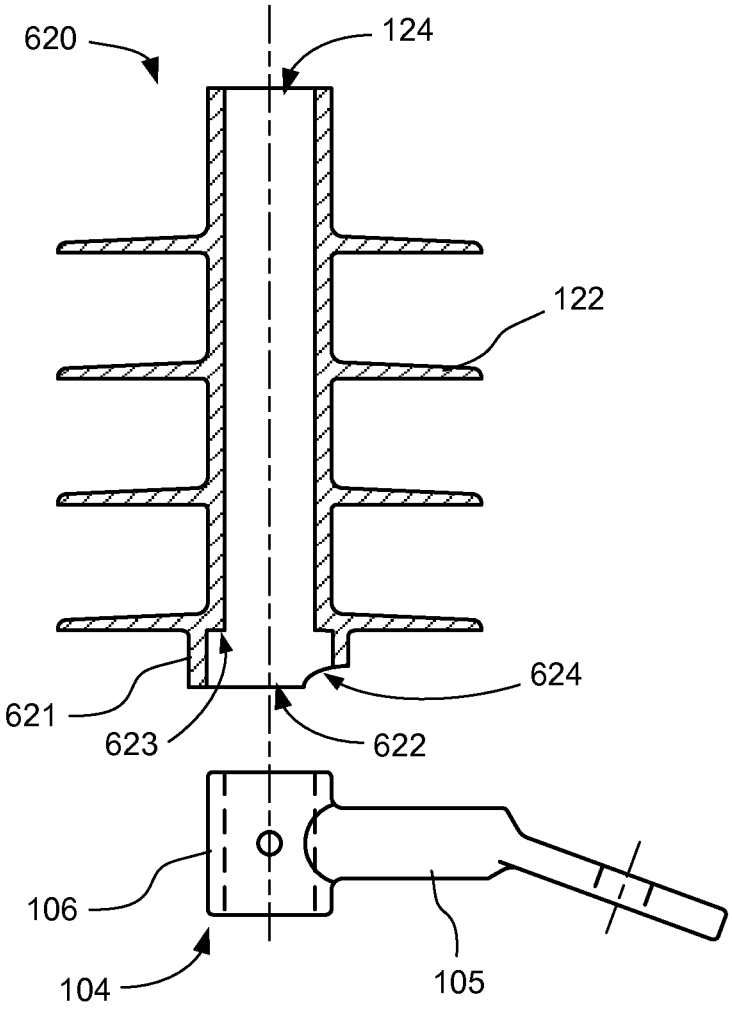
FIG. 6 is an exploded side view showing a mounting bracket with a side cross-section view of an upper shed sleeve, according to another implementation described herein.

FIG. 6 is an exploded side view showing mounting bracket 104 with a side cross-section view of an upper shed sleeve 620 according to another implementation described herein. Upper shed sleeve 620 may generally be configured similarly to upper shed sleeve 120 with central bore 124. However, as shown in FIG. 6, an extension 621 may be included at the bottom of upper shed sleeve 620. Extension 621 may include a larger diameter bore 622 than that of central bore 124. Bore 622 may allow upper shed sleeve 620 to overlap or receive a portion of ring 106 of mounting bracket 104 when both shed sleeve 620 and mounting bracket 104 are installed over insulating rod 102. Extension 621 may, thus, cover the interface between the top edge of ring 106 and a shoulder 623 at the junction of central bore 124 and extension bore 622. Depending on the axial length of extension 621, in one implementation, extension 621 may include a notch 624 to avoid blockage by elbow section 105 of mounting bracket 104.

Figure 7:
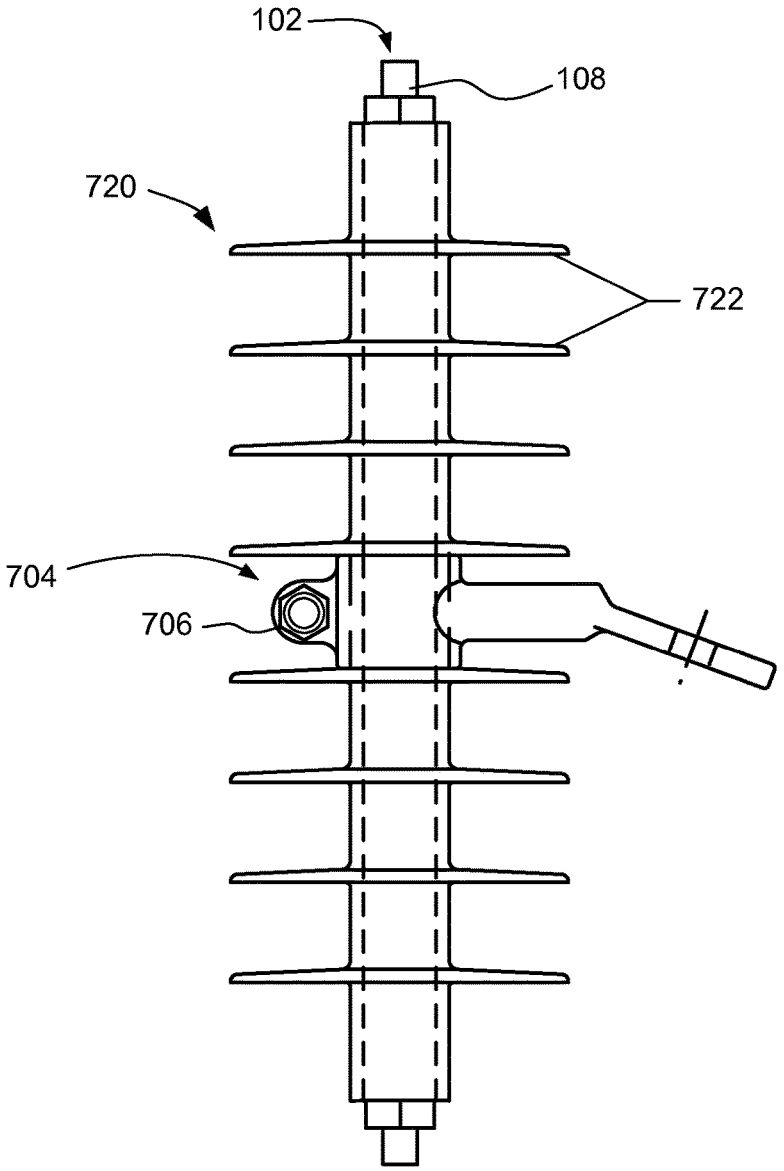
FIG. 7 is a side view of a support bracket for a fuse cutout assembly, according to another implementation described herein.

FIG. 7 is a side view of a support bracket 700, according to another implementation described herein. As shown in FIG. 7, a single shed sleeve 720 may be used to cover insulating rod 102. Similar to upper shed sleeve 120 and lower shed sleeve 130, shed sleeve 720 may include fins 722 and a central bore with a circumference sized such that it may be stretched over the circumference of insulating rod 102 to provide an interference fit. In the configuration of FIG. 7, shed sleeve 720 may be installed over insulating rod 102 prior to a mounting bracket 704 being attached. Mounting bracket 704 may be attached, for example, over a portion of both insulating rod 102 and shed sleeve 720. Thus, in contrast with mounting bracket 104 (e.g., FIG. 3), mounting bracket 704 may use a clamp fitting 706 and/or a two-piece fitting to enable mounting bracket 704 to be positioned over insulating rod 102 and shed sleeve 720. In another implementation, a different configuration for the mounting bracket may be used to secure mounting bracket at either end of insulating rod 102.

Figure 8:
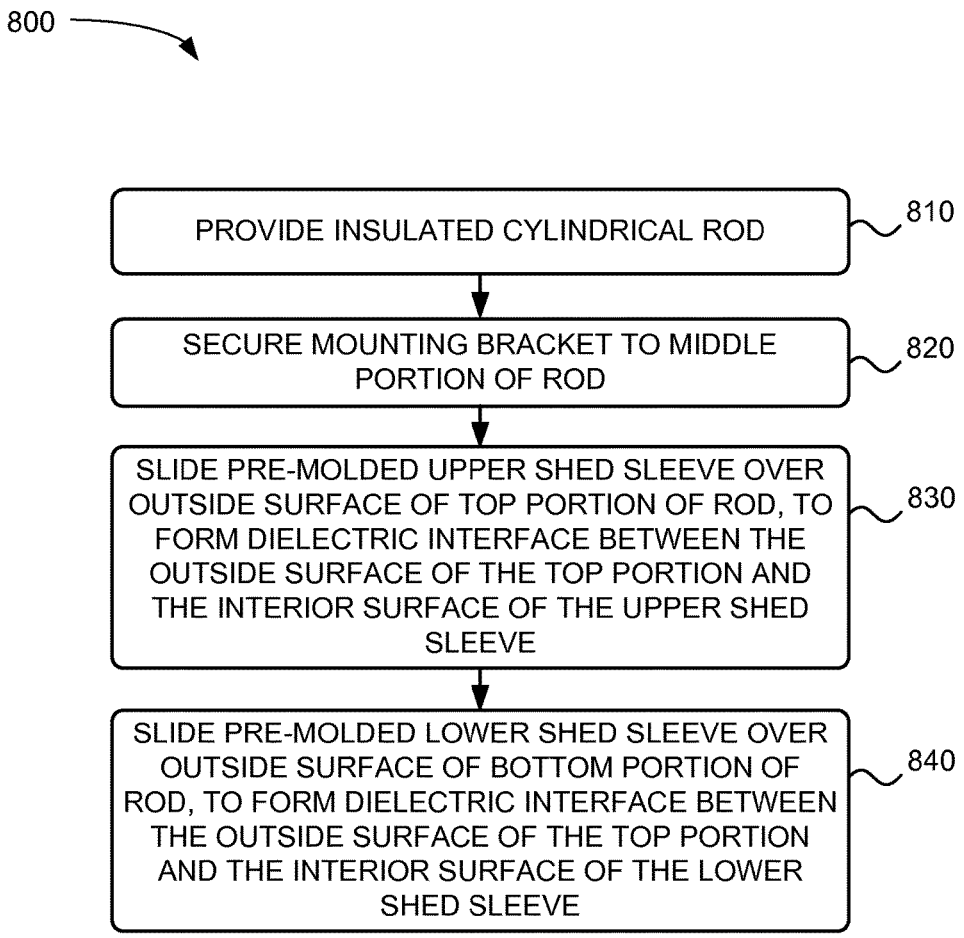
FIG. 8 is a flow diagram of an exemplary process for assembling a support bracket for a fuse cutout, according to an implementation described herein.

FIG. 8 is a flow diagram of an exemplary process for assembling a support bracket for a fuse cutout according to an implementation described herein. As shown in FIG. 8, process 800 may include providing am insulating cylindrical rod (block 810) and securing the mounting bracket to a middle portion of the rod (block 820). For example, insulating rod 102 including threaded standoffs 108 may be provided. Mounting bracket 104 may be slid over insulating rod 102 and secured with pin 107.

Process 800 may also include sliding a pre-molded upper shed sleeve over an outside surface of a top portion of the insulating rod to form dielectric interface between the outside surface of the top portion and the interior surface of the upper shed sleeve (block 830). For example, upper shed sleeve 120 may be pushed over a top end of insulating rod 102 so that the top portion of insulating rod 102 fills central bore 124 and forms a dielectric interface between insulating rod 102 and upper shed sleeve 120 along the exterior of insulating rod 102 between mounting bracket 104 and top threaded standoff 108.

Process 800 may also include sliding a pre-molded lower shed sleeve over an outside surface of a bottom portion of the insulating rod to form dielectric interface between the outside surface of the bottom portion and the interior surface of the lower shed sleeve (block 840). For example, lower shed sleeve 130 may be pushed over a bottom end of insulating rod 102 so that the bottom portion of insulating rod 102 fills central bore 132 and forms a dielectric interface between insulating rod 102 and lower shed sleeve 130 along the exterior of insulating rod 102 between mounting bracket 104 and bottom threaded standoff 108.

Providing pre-molded shed sleeves that may be applied over an insulating rod for a fuse cutout support bracket, simplifies manufacturing and eliminates the complicated overmolding process used to manufacture conventional support brackets. Additionally, the pre-molded shed sleeves reduce instances of manually removing flash. Flash from the conventional molding process must be removed (typically manually) after the part is molded to avoid tracking on the flash line due to contamination buildup. Similarly, scrap from molding defects during manufacturing can be reduced by eliminating instances where an entire support bracket must be scrapped due to defects in a shed. Furthermore, material types for sheds may be easily adapted to meet customer preferences (e.g., a preference for silicone or EPDM). Also, implementations using pre-molded shed sleeves that leave the mounting bracket (e.g., mounting bracket 104) uncovered may eliminate known problems with erosion through the shed insulation around the mounting bracket.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A support bracket for a fuse cutout, comprising:

an insulating rod having a top portion, a bottom portion opposite the top portion, and a middle portion between the top portion and the bottom portion, wherein the insulating rod has an outside diameter;

a first shed sleeve having a first central bore stretched over an outer surface of the top portion such that the first shed sleeve is secured, via an interference fit, to the top portion, wherein an interior surface of the first shed sleeve forms a dielectric interface between the outside surface of the top portion and the interior surface of the first shed sleeve, wherein the first shed sleeve is pre-molded, wherein prior to the first central bore being stretched over the top portion of the insulating rod the outside diameter of the insulating rod is larger than the inside diameter of the first central bore of the first shed sleeve;

a second shed sleeve having a second central bore stretched over an outside surface of the bottom portion such that the second shed sleeve is secured, via another interference fit, to the bottom portion, wherein an interior surface of the second shed sleeve forms a dielectric interface between the outside surface of the bottom portion and the interior surface of the second shed sleeve, wherein the second shed sleeve is pre-molded, wherein prior to the second central bore being stretched over the top portion of the insulating rod the outside diameter of the insulating rod is larger than the inside diameter of the second central bore of the second shed sleeve; and a mounting bracket secured to the middle portion of the insulating rod between the first shed sleeve and the second shed sleeve, wherein at least one of the first shed sleeve and the second shed sleeve further includes an extension having an extension bore, the extension bore having an inner diameter that is larger than the inside diameter of at least one of the first central bore and the second central bore when the first and second central bores are stretched over the top portion of the insulating rod, the extension bore sized and positioned to receive at least a portion of an outer surface of the mounting bracket within the extension.

2. The support bracket of claim 1, wherein the first shed sleeve includes a plurality of fins extending radially from an exterior surface of the first shed sleeve, and wherein the second shed sleeve includes a plurality of fins extending radially from an exterior surface of the second shed sleeve.

3. The support bracket of claim 1, wherein the first shed sleeve is molded prior to the mounting bracket being secured to the middle portion of the insulating rod.

4. The support bracket of claim 1, wherein the insulating rod comprises fiberglass material.

5. The support bracket of claim 1, wherein the first shed sleeve and the second shed sleeve each comprises an ethylene-propylene-dienemonomer (EPDM) elastomer, silicone, or a thermoplastic elastomer.

6. The support bracket of claim 1, wherein the first shed sleeve is identical to the second shed sleeve, and wherein the extension of the first shed sleeve covers a portion of the outer surface of the mounting bracket that is different than a portion of the outer surface of the mounting bracket that is covered by the extension bore of the second shed sleeve.

7. The support bracket of claim 1, wherein the mounting bracket includes a ring, adjacent to the middle portion of the insulating rod, and a flange extending from the ring, and wherein at least a portion of an outer surface of the ring is covered by the extension.

8. The support bracket of claim 1, wherein the mounting bracket includes a ring, adjacent to the middle portion of the insulating rod, and a flange extending from the ring, and wherein the extension covers at least a portion of the ring.

9. The support bracket of claim 1, wherein no additional materials are included at the dielectric interface between the outside surface of the top portion and the interior surface of the first shed sleeve and the dielectric interface between the outside surface of the bottom portion and the interior surface of the second shed sleeve.

10. A support bracket for a fuse cutout, the support bracket comprising:

an insulating rod including a first threaded standoff at a top end of the insulating rod and a second threaded standoff at a bottom end of the insulating rod;

a pre-molded shed sleeve secured over an outside surface of a portion of the insulating rod between the first threaded standoff and the second threaded standoff, wherein an interior surface of the shed sleeve forms a dielectric interface between the outside surface of the insulating rod and the interior surface of the shed sleeve, the pre-molded shed sleeve including a central bore having an inside diameter and an extension having an extension bore, the pre-molded shed sleeve further having a shoulder at a transition between the central bore and the extension bore, wherein prior to the pre-molded shed sleeve being secured over an outside surface of the insulating rod the outside diameter of the insulating rod is larger than the inside diameter of the central bore of the shed sleeve, and wherein the shed sleeve is stretched over the outside of the insulating rod to provide an interference fit between the shed sleeve and the insulating rod; and a mounting bracket secured to a portion of the insulating rod between the first threaded standoff and the second threaded standoff, the mounting bracket including a ring portion sized to be received in the extension bore.

11. The support bracket of claim 10, wherein the extension overlaps at least a portion of an outer surface of the ring portion of the mounting bracket sleeve.

12. The support bracket of claim 10, wherein the shed sleeve comprises an ethylene-propylene-dienemonomer (EPDM) elastomer, silicone, or a thermoplastic elastomer.

13. The support bracket of claim 10, wherein the extension includes a notch sized to accommodate passage of at least a portion of the mounting bracket out from the extension bore.

* * * * *